US009864305B2

(12) United States Patent
Nakamura et al.

(10) Patent No.: US 9,864,305 B2
(45) Date of Patent: Jan. 9, 2018

(54) IMAGE FORMING APPARATUS

(71) Applicant: KYOCERA Document Solutions Inc., Osaka (JP)

(72) Inventors: Satoru Nakamura, Osaka (JP); Teppei Shibuya, Osaka (JP); Ayaka Kurokawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/208,132

(22) Filed: Jul. 12, 2016

(65) Prior Publication Data

US 2017/0023887 A1 Jan. 26, 2017

(30) Foreign Application Priority Data

Jul. 24, 2015 (JP) ..... 2015-147046

(51) Int. Cl.
*G03G 15/16* (2006.01)

(52) U.S. Cl.
CPC ..... *G03G 15/161* (2013.01); *G03G 15/1615* (2013.01); *G03G 2215/1661* (2013.01)

(58) Field of Classification Search
CPC ..... G03G 15/161; G03G 15/1615; G03G 2215/1161
See application file for complete search history.

(56) References Cited

U.S. PATENT DOCUMENTS

2008/0003022 A1* 1/2008 Sakashita ..... G03G 15/1605 399/303
2008/0310877 A1* 12/2008 Hiroi ..... G03G 15/161 399/101
2011/0008081 A1 1/2011 Aoyama et al. ..... 399/327
2011/0033200 A1* 2/2011 Tanaka ..... G03G 15/161 399/101
2011/0058859 A1* 3/2011 Nakamatsu ..... G03G 15/161 399/299
2013/0011158 A1* 1/2013 Meguro ..... G03G 15/0189 399/101
2014/0153957 A1 6/2014 Yonemoto ..... 399/101
2017/0023907 A1* 1/2017 Shibuya ..... G03G 21/0011

FOREIGN PATENT DOCUMENTS

EP 2 278 418 A1 6/2010
JP 2014-109593 A 6/2014

* cited by examiner

*Primary Examiner* — Carla Therrien
(74) *Attorney, Agent, or Firm* — Stein IP, LLC

(57) ABSTRACT

An image forming apparatus includes an intermediate transfer belt, a driving roller, a driven roller, a belt cleaning device, and a counter roller. Toner images formed on image carriers are transferred onto the intermediate transfer belt. The driving and driven rollers rotatably stretch the intermediate transfer belt. The belt cleaning device has a cleaning blade that removes residual toner adhered to the intermediate transfer belt. The counter roller is disposed facing the cleaning blade with the intermediate transfer belt interposed therebetween. The belt cleaning device is disposed at a position that is downstream of the driving roller in a rotation direction of the intermediate transfer belt but is upstream of the driven roller in the rotation direction of the intermediate transfer belt. A leading end edge portion of the cleaning blade is disposed upstream of a top of the counter roller in the rotation direction of the intermediate transfer belt.

9 Claims, 3 Drawing Sheets

IMAGE FORMING APPARATUS

INCORPORATION BY REFERENCE

This application is based upon and claims the benefit of priority from the corresponding Japanese Patent Application No. 2015-147046 filed on Jul. 24, 2015, the entire contents of which are incorporated herein by reference.

BACKGROUND

The present disclosure relates to an image forming apparatus, and in particular, to an image forming apparatus including a belt cleaning device that removes residual toner adhered to an intermediate transfer belt.

Conventionally, image forming apparatuses, such as copiers and printers, include a belt cleaning device that removes residual toner adhered to an intermediate transfer belt onto which a toner image formed on a photosensitive drum (an image carrier) is transferred.

For example, there have been know image forming apparatuses that include a plurality of photosensitive drums (image carriers), an intermediate transfer belt, a plurality of stretching rollers that rotatably stretch the intermediate transfer belt, and a belt cleaning unit (a belt cleaning device) that removes residual toner adhered to the intermediate transfer belt. In such image forming apparatuses, the plurality of stretching rollers include a driving roller that is disposed at one end in an arrangement direction of the plurality of photosensitive drums and that drives the intermediate transfer belt to rotate, and a tension roller (a driven roller) that is disposed at the other end in the arrangement direction of the plurality of photosensitive drums. The belt cleaning unit is disposed at a position exterior to the tension roller so as to face the tension roller with the intermediate transfer belt interposed between the belt cleaning unit and the tension roller.

SUMMARY

According to an aspect of the present disclosure, an image forming apparatus includes a plurality of image carriers, an intermediate transfer belt formed in an endless shape, a plurality of stretching rollers, a belt cleaning device, and a counter roller. Onto the intermediate transfer belt, toner images formed on the image carriers are transferred. The stretching rollers rotatably stretch the intermediate transfer belt. The belt cleaning device has a cleaning blade of which a leading end portion is oriented toward an upstream side in a rotation direction of the intermediate transfer belt and abuts on an outer circumferential surface of the intermediate transfer belt to thereby remove residual toner adhered to the intermediate transfer belt. The counter roller is disposed facing the cleaning blade with the intermediate transfer belt interposed therebetween in such a manner that the counter roller is in contact with an inner circumferential surface of the intermediate transfer belt. The plurality of stretching rollers include a driving roller that is disposed at one end in an arrangement direction of the plurality of image carriers and that drives the intermediate transfer belt to rotate, and a driven roller that is disposed at another end in the arrangement direction. The belt cleaning device is disposed at a position that is downstream of the driving roller in the rotation direction of the intermediate transfer belt but is upstream of the driven roller in the rotation direction of the intermediate transfer belt. A top of the counter roller is disposed to be level with a top of the driving roller and a top of the driven roller, or above the top of the driving roller and the top of the driven roller. A leading end edge portion of the cleaning blade that abuts on the intermediate transfer belt is disposed upstream of the top of the counter roller in the rotation direction of the intermediate transfer belt.

Other features and specific advantages of the present disclosure will become apparent from the following descriptions of preferred embodiments.

DETAILED DESCRIPTION

Hereinafter, an embodiment of the present disclosure will be described with reference to the accompanying drawings.

With reference to FIG. 1 to FIG. 4, a description will now be given of an image forming apparatus 100 of an embodiment of the present disclosure.

The image forming apparatus 100 (herein, a color printer) of the present embodiment is a quadruple tandem type color printer that performs image formation with four photosensitive drums 1*a*, 1*b*, 1*c*, and 1*d* corresponding to four different colors (yellow, cyan, magenta, and black) and arranged parallel to each other.

Figure 1:
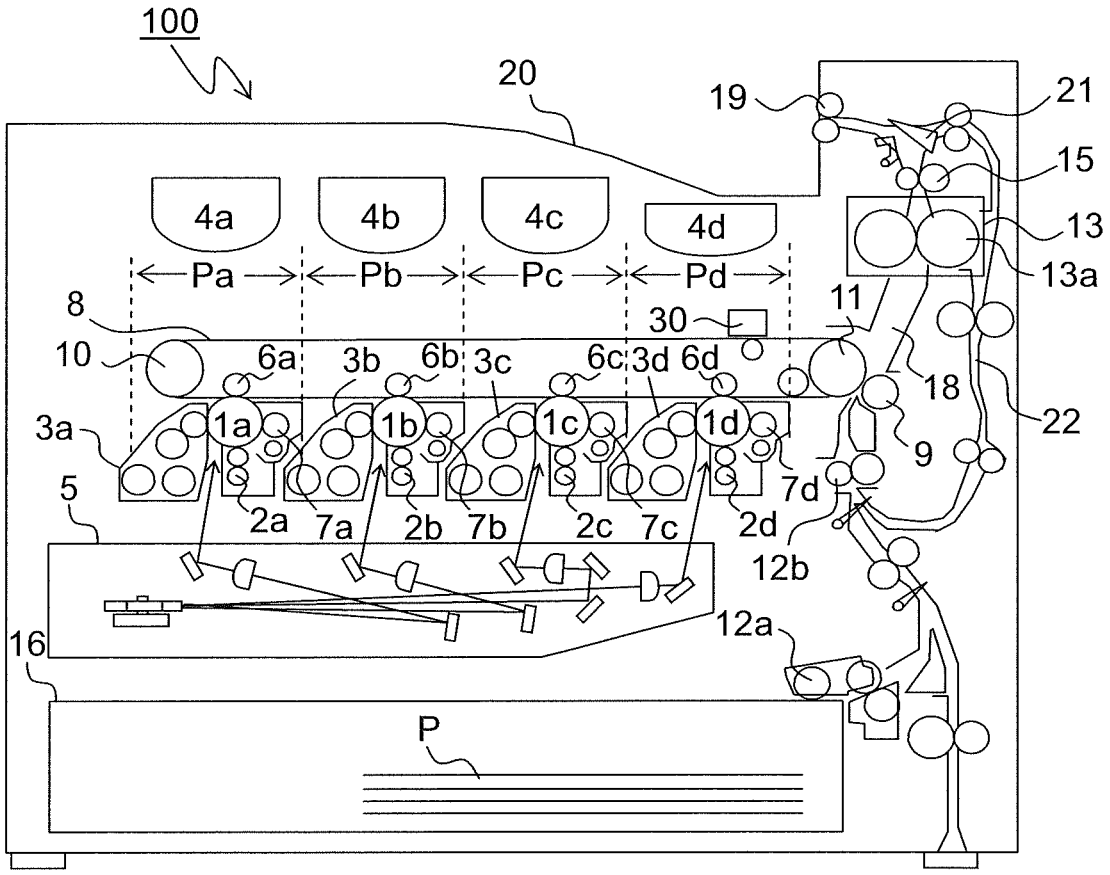
FIG. 1 is a schematic sectional view of a structure of an image forming apparatus of an embodiment of the present disclosure.

In an apparatus main body of the image forming apparatus 100, four image forming portions Pa, Pb, Pc, and Pd are arranged in order from a left side in FIG. 1. These image forming portions Pa to Pd are provided corresponding to images of four different colors (yellow, cyan, magenta, and black), and the image forming portions Pa to Pd sequentially form yellow, cyan, magenta, and black images through charging, exposure, developing, and transfer steps.

These image forming portions Pa to Pd are provided with photosensitive drums 1*a* to 1*d* that carry visible images (toner images) of corresponding colors, and further, an intermediate transfer belt 8 that rotates in a counterclockwise direction in FIG. 1 is arranged adjacent to the image forming portions Pa to Pd. The toner images formed on these photosensitive drums 1*a* to 1*d* are transferred one after another onto the intermediate transfer belt 8 moving abutting on the photosensitive drums 1*a* to 1*d*, and thereafter, at a secondary transfer roller 9, the toner images are transferred at the same time onto a sheet P, which is an example of a recording medium, and further, the toner images on the sheet P are fixed thereon at a fixing device 13, and then the sheet P is discharged out of the apparatus main body. By rotating the photosensitive drums 1*a* to 1*d* in a clockwise direction in FIG. 1, an image forming process is carried out with respect to each of the photosensitive drums 1*a* to 1*d*.

The sheet P, onto which the toner images are to be transferred, is accommodated in a sheet cassette 16 disposed in a lower part of the apparatus, and is conveyed via a sheet feeding roller 12*a* and a registration roller pair 12*b* to the secondary transfer roller 9. As the intermediate transfer belt 8, a dielectric resin sheet is used, typically in a form of a (seamless) belt having no seam. The intermediate transfer belt 8 and the secondary transfer roller 9 are driven to rotate by a belt driving motor (not shown) at a same linear speed as the photosensitive drums 1*a* to 1*d*. For the purpose of removing residual toner remaining on a surface of the intermediate transfer belt 8, a belt cleaning device 30 is disposed at the image forming portion Pd.

Next, the image forming portions Pa to Pd will be described. Around and below the rotatably arranged photosensitive drums 1*a* to 1*d*, the following are provided: charging devices 2*a*, 2*b*, 2*c*, and 2*d* that charge the photosensitive drums 1*a* to 1*d*, an exposure unit 5 that performs exposure on each of the photosensitive drums 1*a* to 1*d* based on image data, developing units 3*a*, 3*b*, 3*c*, and 3*d* that develop, with toner, electrostatic latent images formed on the photosensitive drums 1*a* to 1*d*, and cleaning devices 7*a*, 7*b*, 7*c*, and 7*d* that collect and remove developer (toner) remaining on the photosensitive drums 1*a* to 1*d* after the toner images on the photosensitive drums 1*a* to 1*d* are transferred.

On receipt of image data from a host device such as a personal computer, first, the charging devices 2*a* to 2*d* uniformly charge surfaces of the photosensitive drums 1*a* to 1*d*. Next, based on the image data, the exposure unit 5 irradiates the photosensitive drums 1*a* to 1*d* with light to thereby form electrostatic latent images on the photosensitive drums 1*a* to 1*d* according to the image data. The developing units 3*a* to 3*d* are provided with developing rollers disposed facing the photosensitive drums 1*a* to 1*d*, and the developing units 3*a* to 3*d* are filled with a predetermined amount of two-component developer containing toner of yellow, magenta, cyan, and black.

When a proportion of toner in the two-component developer in each of the developing units 3*a* to 3*d* falls short of a reference value, toner is supplied from toner containers 4*a* to 4*d* to the developing units 3*a* to 3*d*. The toner is fed onto the photosensitive drums 1*a* to 1*d* by the developing units 3*a* to 3*d*, and electrostatically adheres thereto. Thereby, toner images are formed according to electrostatic latent images formed by the exposure that has been performed by the exposure unit 5.

Then, an electric field with a predetermined transfer voltage is applied between primary transfer rollers 6*a* to 6*d* and the photosensitive drums 1*a* to 1*d* by the primary transfer rollers 6*a* to 6*d*, and yellow, cyan, magenta, and black toner images formed on the photosensitive drums 1*a* to 1*d* are primarily transferred onto the intermediate transfer belt 8. The toner images of the four colors are formed with a predetermined positional relationship between them that is previously determined for forming a predetermined full-color image. Thereafter, in preparation for formation of new electrostatic latent images to be subsequently performed, toner remaining on the surfaces of the photosensitive drums 1*a* to 1*d* is removed by the cleaning devices 7*a* to 7*d*.

The intermediate transfer belt 8 is wound around and between the driven roller 10 and the driving roller 11. When the intermediate transfer belt 8 starts to rotate in the counterclockwise direction along with rotation of the driving roller 11 caused by the above-mentioned belt driving motor, the sheet P is conveyed, at a predetermined timing, from the registration roller pair 12*b* to a nip portion (a secondary transfer nip portion) formed between the intermediate transfer belt 8 and the secondary transfer roller 9 that is provided adjacent to the intermediate transfer belt 8, and at the nip portion, a full-color image is secondarily transferred onto the sheet P. The sheet P onto which the full-color toner image has been transferred is conveyed to the fixing device 13.

The sheet P conveyed to the fixing device 13 has the toner image fixed on the surface thereof by receiving heat and pressure while passing through a fixing nip portion of a fixing roller pair 13*a* composed of a heating roller and a pressure roller, whereby the predetermined full-color image is formed. The sheet P on which the full-color image has been formed passes through a conveyance roller pair 15 to reach a branching position of a sheet conveyance path 18. The sheet P is directed by a branching member 21 disposed at the branching portion to one of a plurality of conveyance directions, to be then discharged as it is (or after it is sent to a double-sided copying conveyance path 22 and subjected to double-sided copying) onto a discharge tray 20 via a discharge roller pair 19.

The sheet conveyance path 18 is specifically divided into two paths which extend leftward and rightward at a position downstream of the conveyance roller pair 15, and one of the paths (the path extending leftward as seen in FIG. 1) leads to the discharge tray 20. On the other hand, the other path (the path branching rightward as seen in FIG. 1) leads to the double-sided copying conveyance path 22. In a case of forming an image on each side of the sheet P, the sheet P is conveyed such that part thereof temporarily projects to outside the apparatus from the discharge roller pair 19.

Thereafter, by reversely rotating the discharge roller pair 19 and swinging the branching member 21 substantially horizontally, the sheet P is guided along an upper surface of the branching member 21 to the double-sided copying conveyance path 22, and is then conveyed back to the secondary transfer roller 9 with its image side reversed. Then, a next image formed on the secondary transfer belt 8 is transferred by the secondary transfer roller 9 onto the no-image side of the sheet P, then the sheet P is conveyed to the fixing device 13 where the toner image is fixed thereon, and then the sheet P is discharged onto the discharge tray 20.

Next, a structure of and around the belt cleaning device 30 will be described.

Figure 2:
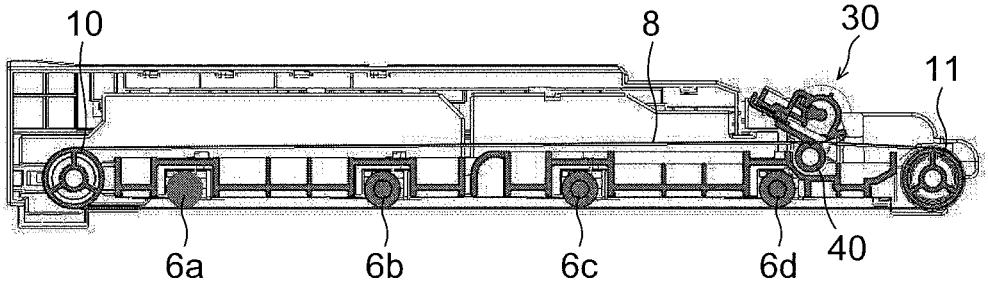
FIG. 2 is a sectional view of a structure of, and around, a belt cleaning device and an intermediate transfer belt of the image forming apparatus of the embodiment of the present disclosure.

As shown in FIG. 2, the intermediate transfer belt 8 is rotatably stretched by a plurality of (here, two) stretching rollers. The stretching rollers include a driving roller 11 that is disposed at one end (a right end in FIG. 2) in an arrangement direction of the photosensitive drums 1*a* to 1*d* (a left-right direction in FIG. 2) and that drives the intermediate transfer belt 8 to rotate, and a driven roller 10 that is disposed at the other end (a left end in FIG. 2) in the arrangement direction.

Figure 3:
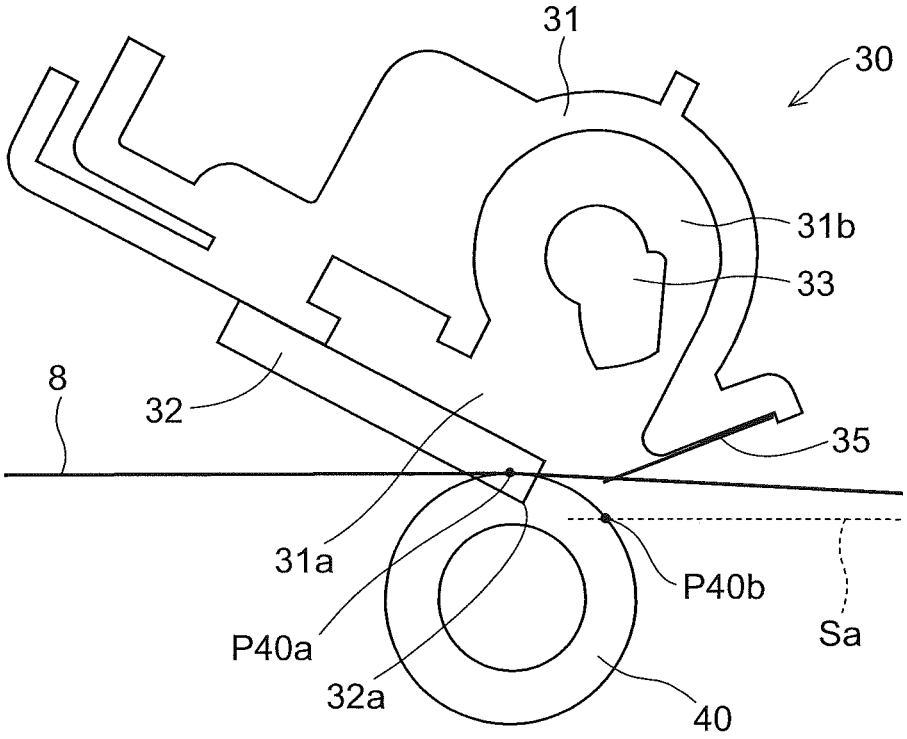
FIG. 3 is a sectional view of the structure of, and around, the belt cleaning device of the image forming apparatus of the embodiment of the present disclosure.

The belt cleaning device 30 is disposed at a position that is downstream of the driving roller 11 in the rotation direction of the intermediate transfer belt 8 but is upstream of the driven roller 10 in the rotation direction of the intermediate transfer belt 8. As shown in FIG. 3, the belt cleaning device 30 includes a housing 31, a cleaning blade 32, a collecting screw 33, and a seal member 35 that is formed in a shape of sheet.

The housing 31 has an opening portion 31*a* that faces the intermediate transfer belt 8, and a waste toner accommodating portion 31*b* that accommodates waste toner scraped off from the surface of the intermediate transfer belt 8.

The cleaning blade 32 is fixed to a position downstream (on a left side in FIG. 3) of the opening portion 31*a* of the housing 31 in the rotation direction of the intermediate transfer belt 8. Further, the cleaning blade 32 abuts on an outer circumferential surface of the intermediate transfer belt 8, and removes residual toner adhered to the intermediate transfer belt 8. As the cleaning blade 32, for example, a polyurethane-rubber blade is used, and the cleaning blade 32 is attached at a predetermined angle, with a leading end portion thereof oriented toward an upstream side in the rotation direction of the intermediate transfer belt 8. An amount by which the cleaning blade 32 digs into the intermediate transfer belt 8 is set, for example, to 1.0 mm or more. Material, hardness, size, and contact pressure onto the intermediate transfer belt 8, etc. of the cleaning blade 32 are appropriately set according to specifications of the intermediate transfer belt 8.

At a position opposite to the cleaning blade 32 with respect to the intermediate transfer belt 8, there is disposed a counter roller 40, which is provided so as to be in contact with an inner circumferential surface of the intermediate transfer belt 8 and receives the contact pressure of the cleaning blade 32. The counter roller 40 is caused to rotate in the counterclockwise direction in FIG. 3 at a same linear speed as the intermediate transfer belt 8 by receiving driving force from the same drive source (the belt driving motor) as the driving roller 11 does. The counter roller 40 has a diameter of 10 mm or more, for example, and is disposed such that a distance in a horizontal direction (a right-left direction in FIG. 3) between a center of the counter roller 40 and a center of the driving roller 11 is approximately 40 mm.

Residual toner removed from the surface of the intermediate transfer belt 8 by the cleaning blade 32 is discharged to outside the belt cleaning device 30 along with rotation of the collecting screw 33, and is then conveyed into a toner collection container (not shown) to be stored therein.

The seal member 35 is fixed to the housing 31, at a position upstream (on a right side in FIG. 3) of the opening portion 31*a* of the housing 31 in the rotation direction of the intermediate transfer belt 8. One end portion (a right end in FIG. 3) of the seal member 35 is fixed by adhesion to the housing 31, and another end portion (a left end in FIG. 3) of the seal member 35 constitutes a free end. The free end of the seal member 35 is oriented toward a downstream side in the rotation direction of the intermediate transfer belt 8, and is in contact with the outer circumferential surface of the intermediate transfer belt 8. The seal member 35 helps reduce leakage of the waste toner from the housing 31 through a gap between the housing 31 and the intermediate transfer belt 8. As the seal member 35, a 100 μm urethane sheet is used, for example, but a thin sheet other than a urethane sheet may be used.

Figure 4:
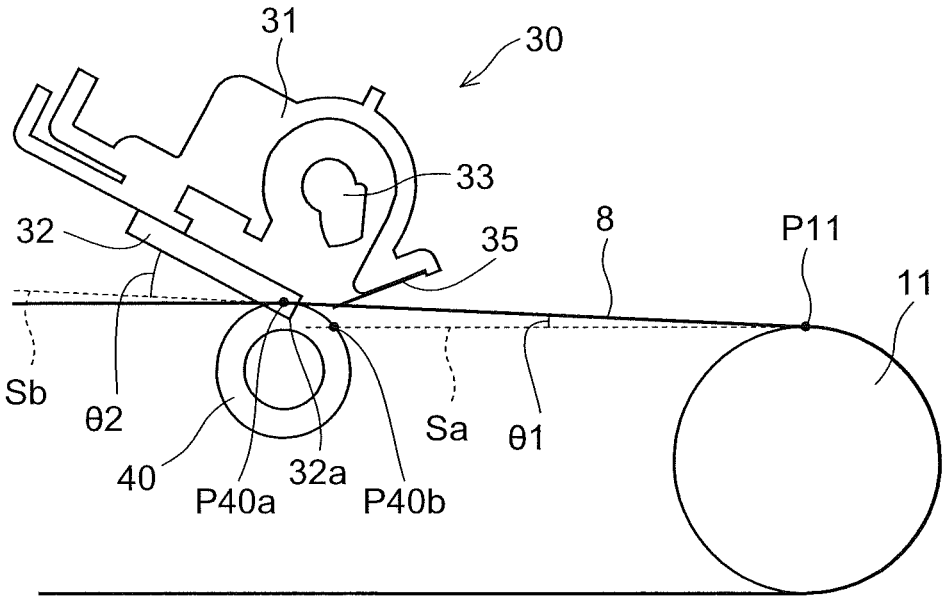
FIG. 4 is a sectional view of a structure of, and around, the belt cleaning device and a driving roller of the image forming apparatus of the embodiment of the present disclosure.

Here, in the present embodiment, as shown in FIG. 4, a top (a highest point) P40*a* of the counter roller 40 is disposed to be level with a top P11 of the driving roller 11 and a top of the driven roller 10, or slightly above the top P11 of the driving roller 11 and the top of the driven roller 10.

As shown in FIG. 3, a leading end edge portion 32*a* of the cleaning blade 32 that abuts on the intermediate transfer belt 8 is disposed upstream (on a right side in FIG. 3) of the top P40*a* of the counter roller 40 in the rotation direction of the intermediate transfer belt 8. The leading end edge portion 32*a* is disposed, for example, 0.5 mm or more upstream of the top P40*a* of the counter roller 40 in the rotation direction of the intermediate transfer belt 8.

The leading end edge portion 32*a* is disposed downstream (on a left side in FIG. 3) of an intersection position P40*b* in the rotation direction of the intermediate transfer belt 8, the intersection position P40*b* being a position at which a horizontal plane Sa that passes through the top P11 of the driving roller 11 and an outer circumferential surface of the counter roller 40 intersect with each other.

As shown in FIG. 4, when a tilt angle of a part of the intermediate transfer belt 8 that extends from the driving roller 11 toward the counter roller 40 with respect to a horizontal plane is represented by θ1, and a tilt angle of the cleaning blade 32 with respect to the part of the intermediate transfer belt 8 that extends from the driving roller 11 toward the counter roller 40 is represented by θ2, θ1<θ2 is fulfilled. Specifically, the tilt angle θ1 fulfills 0°≤θ1≤15°, and the tilt angle θ2 fulfills 10°≤θ2≤40°. The tilt angles θ1 and θ2 fulfill θ2−θ1≤30°. In the present embodiment, the tilt angle θ1 is approximately 5°, and the tilt angle θ2 is approximately 25°. In FIG. 4, a broken line Sb indicates a plane extended from the part of the intermediate transfer belt 8 extending from the driving roller 11 toward the counter roller 40.

In the present embodiment, as has been described above, the belt cleaning device 30 is disposed at a position that is downstream of the driving roller 11 in the rotation direction of the intermediate transfer belt 8 but is upstream of the driven roller 10 in the rotation direction of the intermediate transfer belt 8. This arrangement allows the belt cleaning device 30 to be disposed between the driving roller 11 and the driven roller 10 in the arrangement direction of the photosensitive drums 1*a* to 1*d* (the left-right direction in FIG. 1), and thus makes it possible to reduce increase of an installation space for the image forming apparatus 100.

Furthermore, the counter roller 40 is provided, which is disposed so as to face the cleaning blade 32 with the intermediate transfer belt 8 interposed therebetween in such a manner that the counter roller 40 is in contact with the inner circumferential surface of the intermediate transfer belt 8. This arrangement allows the contact pressure of the cleaning blade 32 to be received by the counter roller 40, and thus makes it possible to reduce the possibility of degradation of the cleaning performance caused by the intermediate transfer belt 8 escaping (warping away from the cleaning blade 32).

Furthermore, the leading end edge portion 32*a* of the cleaning blade 32 that abuts on the intermediate transfer belt 8 is disposed upstream (on a right side in FIG. 3) of the top P40*a* of the counter roller 40 in the rotation direction of the intermediate transfer belt 8. This arrangement helps reduce the possibility of the rotation speed of the intermediate transfer belt 8 becoming unstable and the possibility of the leading end of the cleaning blade 32 curving (blade curling up) toward the downstream side in the rotation direction of the intermediate transfer belt 8. Note that, if the leading end edge portion 32*a* is disposed downstream (on a left side in FIG. 3) of the top P40*a* of the counter roller 40 in the rotation direction of the intermediate transfer belt 8, disadvantageously large warp of the intermediate transfer belt 8 occurs around the cleaning blade 32, which prevents the intermediate transfer belt 8 from rotating at a constant rotation speed. Moreover, the leading end of the cleaning blade 32 may warp (blade curling-up may occur) toward the downstream side in the rotation direction of the intermediate transfer belt 8.

As described above, the leading end edge portion 32*a* is disposed 0.5 mm or more upstream of the top P40*a* of the counter roller 40 in the rotation direction of the intermediate transfer belt 8. This arrangement makes it possible to securely prevent the leading end edge portion 32*a* from being disposed downstream of the top P40*a* of the counter roller 40 in the rotation direction of the intermediate transfer belt 8 even when there is a member dimension error or a member fitting error.

As described above, the amount by which the cleaning blade 32 digs into the intermediate transfer belt 8 is 1.0 mm or more. This arrangement allows the cleaning blade 32 to securely abut on the intermediate transfer belt 8.

As described above, when the tilt angle of the part of the intermediate transfer belt 8 that extends from the driving roller 11 toward the counter roller 40 with respect to the horizontal plane is represented by θ1, and the tilt angle of the cleaning blade 32 with respect to the part of the intermediate transfer belt 8 that extends from the driving roller 11 toward the counter roller 40 is represented by θ2, θ1<θ2 holds. This arrangement helps secure a satisfactory cleaning performance.

Further, as described above, the tilt angle θ1 fulfills 0°≤θ1≤15°, and the tilt angle θ2 fulfills 10°≤θ2≤40°. This arrangement helps easily secure a satisfactory cleaning performance.

Further, as described above, the tilt angles θ1 and θ2 fulfill θ2−θ1≤30°. This arrangement helps reduce the possibility of the leading end of the cleaning blade 32 warping (blade curling-up occurring) toward the downstream side in the rotation direction of the intermediate transfer belt 8.

Further, as described above, the leading end edge portion 32*a* is disposed downstream (on a left side in FIG. 3) of the intersection position P40*b* in the rotation direction of the intermediate transfer belt 8, the intersection position P40*b* being a position at which the horizontal plane S1 that passes through the top P11 of the driving roller 11 and the outer circumferential surface of the counter roller 40 intersect with each other. This arrangement allows the contact pressure of the cleaning blade 32 to be securely received by the counter roller 40, and thus makes it possible to easily reduce the possibility of the intermediate transfer belt 8 escaping (warping away from the cleaning blade 32) to degrade the cleaning performance.

Next, a description will be given of confirmation experiments conducted to confirm the above advantages.

In these confirmation experiments, the above-described image forming apparatus 100 was used, and the diameter of the counter roller 40 was 10 mm. And, with the tilt angle θ1 set to angles from 0° to 15° at intervals of 5°, and the tilt angle θ2 set to angles from 10° to 40° at intervals of 5°, the cleaning performance of the cleaning blade 32 in cleaning the intermediate transfer belt 8 and the presence/absence of the occurrence of blade curling-up (that is, warping of the leading end of the cleaning blade toward the downstream side in the rotation direction of the intermediate transfer belt) were checked. Results of the confirmation experiments are shown in Table 1 and Table 2. As for the cleaning performance, a case where residual toner was completely removed is indicated by "good", while a case where incomplete removal of residual toner was observed is indicated by "poor". As for blade curling-up, a case where no blade curling-up was observed is indicated by "good", while a case where blade curling-up was observed is indicated by "poor".

TABLE 1

| | | θ2 [°] | | | | | | |
|---|---|---|---|---|---|---|---|---|
| | | 10 | 15 | 20 | 25 | 30 | 35 | 40 |
| θ1 [°] | 0 | good | good | good | good | good | good | good |
| | 5 | good | good | good | good | good | good | good |
| | 10 | poor | good | good | good | good | good | good |
| | 15 | poor | poor | good | good | good | good | good |

TABLE 2

| | | θ2 [°] | | | | | | |
|---|---|---|---|---|---|---|---|---|
| | | 10 | 15 | 20 | 25 | 30 | 35 | 40 |
| θ1 [°] | 0 | good | good | good | good | good | poor | poor |
| | 5 | good | good | good | good | good | good | poor |
| | 10 | good | good | good | good | good | good | good |
| | 15 | good | good | good | good | good | good | good |

From Table 1, it is clear that, with the arrangement where θ1<θ2, it is possible to achieve a satisfactory cleaning performance of the cleaning blade 32 in cleaning the intermediate transfer belt 8.

From Table 2, it is clear that, with the arrangement where θ2−θ1≤30°, it is possible to reduce occurrence of blade curling-up.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the above descriptions have dealt with a case where the present disclosure is applied to a color printer, but the present disclosure is not limited to this. Needless to say, the present disclosure is applicable to various image forming apparatuses, such as color copiers and facsimile machines, provided with an intermediate transfer belt, a belt cleaning device, and a counter roller.

The above description of embodiment have dealt with an example where the tilt angle θ1 fulfills 0°≤θ1≤15°, and the tilt angle θ2 fulfills 10°≤θ2≤40°, but the present disclosure is not limited to this. One or both of 0°≤θ1≤15° and 10°≤θ2≤40° may be unfulfilled.

What is claimed is:

1. An image forming apparatus comprising:

a plurality of image carriers;

an intermediate transfer belt that is formed in an endless shape, and onto which toner images formed on the image carriers are transferred;

a plurality of stretching rollers that rotatably stretch the intermediate transfer belt;

a belt cleaning device having a cleaning blade of which a leading end portion is oriented toward an upstream side in a rotation direction of the intermediate transfer belt and abuts on an outer circumferential surface of the intermediate transfer belt to thereby remove residual toner adhered to the intermediate transfer belt; and a counter roller that is disposed facing the cleaning blade with the intermediate transfer belt interposed therebetween in such a manner that the counter roller is in contact with an inner circumferential surface of the intermediate transfer belt, wherein the plurality of stretching rollers include a driving roller that is disposed at one end in an arrangement direction of the plurality of image carriers and that drives the intermediate transfer belt to rotate, and a driven roller that is disposed at another end in the arrangement direction, the plurality of image carriers are disposed at positions that are upstream of the driving roller in the rotation direction of the intermediate transfer belt but are downstream of the driven roller in the rotation direction of the intermediate transfer belt, the belt cleaning device and the counter roller are disposed at positions that are downstream of the driving roller in the rotation direction of the intermediate transfer belt but are upstream of the driven roller in the rotation direction of the intermediate transfer belt, a top of the counter roller is disposed above the top of the driving roller and the top of the driven roller, a leading end edge portion of the cleaning blade that abuts on the intermediate transfer belt is disposed upstream of the top of the counter roller in the rotation direction of the intermediate transfer belt, and when a tilt angle of a part of the intermediate transfer belt that extends from the driving roller toward the counter roller with respect to a horizontal plane is represented by $\theta 1$, and a tilt angle of the cleaning blade with respect to an extended plane extended from the part of the intermediate transfer belt that extends from the driving roller toward the counter roller is represented by $\theta 2$, $\theta 1<\theta 2$ holds.

2. The image forming apparatus according to claim 1, wherein the leading end edge portion is disposed 0.5 mm or more upstream of the top of the counter roller in the rotation direction of the intermediate transfer belt.

3. The image forming apparatus according to claim 1, wherein the cleaning blade digs into the intermediate transfer belt by an amount of 1.0 mm or more.

4. The image forming apparatus according to claim 1, wherein the tilt angle $\theta 1$ fulfills $0°<\theta 1\leq 15°$, and the tilt angle $\theta 2$ fulfills $10°\leq\theta 2\leq 40°$.

5. The image forming apparatus according to claim 1, wherein the tilt angles $\theta 1$ and $\theta 2$ fulfill $\theta 2-\theta 1\leq 30°$.

6. The image forming apparatus according to claim 1, wherein the leading end edge portion is disposed downstream of an intersection position in the rotation direction of the intermediate transfer belt, the intersection position being a position at which a horizontal plane that passes through the top of the driving roller and an outer circumferential surface of the counter roller intersect with each other.

7. The image forming apparatus according to claim 1, wherein the extended plane is located at a position that is downstream of the counter roller in the rotation direction of the intermediate transfer belt.

8. An image forming apparatus comprising:

a plurality of image carriers;

an intermediate transfer belt that is formed in an endless shape, and onto which toner images formed on the image carriers are transferred;

a plurality of stretching rollers that rotatably stretch the intermediate transfer belt;

a belt cleaning device having a cleaning blade of which a leading end portion is oriented toward an upstream side in a rotation direction of the intermediate transfer belt and abuts on an outer circumferential surface of the intermediate transfer belt to thereby remove residual toner adhered to the intermediate transfer belt; and a counter roller that is disposed facing the cleaning blade with the intermediate transfer belt interposed therebetween in such a manner that the counter roller is in contact with an inner circumferential surface of the intermediate transfer belt, wherein the plurality of stretching rollers include a driving roller that is disposed at one end in an arrangement direction of the plurality of image carriers and that drives the intermediate transfer belt to rotate, and a driven roller that is disposed at another end in the arrangement direction, the belt cleaning device is disposed at a position that is downstream of the driving roller in the rotation direction of the intermediate transfer belt but is upstream of the driven roller in the rotation direction of the intermediate transfer belt, a top of the counter roller is disposed to be level with a top of the driving roller and a top of the driven roller, or above the top of the driving roller and the top of the driven roller, a leading end edge portion of the cleaning blade that abuts on the intermediate transfer belt is disposed upstream of the top of the counter roller in the rotation direction of the intermediate transfer belt, the leading end edge portion is disposed 0.5 mm or more upstream of the top of the counter roller in the rotation direction of the intermediate transfer belt, when a tilt angle of a part of the intermediate transfer belt that extends from the driving roller toward the counter roller with respect to a horizontal plane is represented by $\theta 1$, and a tilt angle of the cleaning blade with respect to the part of the intermediate transfer belt that extends from the driving roller toward the counter roller is represented by $\theta 2$, $\theta 1<\theta 2$ holds, and the tilt angle $\theta 1$ fulfills $0°\leq\theta 1\leq 15°$, and the tilt angle $\theta 2$ fulfills $10°\leq\theta 2\leq 40°$.

9. An image forming apparatus comprising:

a plurality of image carriers;

an intermediate transfer belt that is formed in an endless shape, and onto which toner images formed on the image carriers are transferred;

a plurality of stretching rollers that rotatably stretch the intermediate transfer belt;

a belt cleaning device having a cleaning blade of which a leading end portion is oriented toward an upstream side in a rotation direction of the intermediate transfer belt and abuts on an outer circumferential surface of the intermediate transfer belt to thereby remove residual toner adhered to the intermediate transfer belt; and a counter roller that is disposed facing the cleaning blade with the intermediate transfer belt interposed therebetween in such a manner that the counter roller is in contact with an inner circumferential surface of the intermediate transfer belt, wherein the plurality of stretching rollers include a driving roller that is disposed at one end in an arrangement direction of the plurality of image carriers and that drives the intermediate transfer belt to rotate, and a driven roller that is disposed at another end in the arrangement direction, the belt cleaning device is disposed at a position that is downstream of the driving roller in the rotation direction of the intermediate transfer belt but is upstream of the driven roller in the rotation direction of the intermediate transfer belt, a top of the counter roller is disposed to be level with a top of the driving roller and a top of the driven roller, or above the top of the driving roller and the top of the driven roller, a leading end edge portion of the cleaning blade that abuts on the intermediate transfer belt is disposed upstream of the top of the counter roller in the rotation direction of the intermediate transfer belt, the leading end edge portion is disposed 0.5 mm or more upstream of the top of the counter roller in the rotation direction of the intermediate transfer belt, when a tilt angle of a part of the intermediate transfer belt that extends from the driving roller toward the counter roller with respect to a horizontal plane is represented by $\theta 1$, and a tilt angle of the cleaning blade with respect to the part of the intermediate transfer belt that extends from the driving roller toward the counter roller is represented by $\theta 2$, $\theta 1 < \theta 2$ holds, and the tilt angles $\theta 1$ and $\theta 2$ fulfill $\theta 2 - \theta 1 \leq 30°$.

* * * * *